US005647108A

United States Patent [19]

Crook

[11] Patent Number: 5,647,108

[45] Date of Patent: Jul. 15, 1997

[54] RECEPTACLE FOR ASHES OF DECEASED

[75] Inventor: Robert Sydney Crook, Frenchs Forest, Australia

[73] Assignee: Taghulk Pty Limited, Hornsby Heights, Australia

[21] Appl. No.: 610,516

[22] Filed: Mar. 4, 1996

Related U.S. Application Data

[63] Continuation of Ser. No. 211,155, filed as PCT/AU92/00494, Sep. 18, 1992, abandoned.

[30] Foreign Application Priority Data

Sep. 19, 1991 [AU] Australia ..... PK8481

[51] Int. Cl.[6] ..... A61G 17/00

[52] U.S. Cl. ..... 27/1; 27/DIG. 1

[58] Field of Search ..... 27/1, 2, DIG. 1; 47/41.14, 41.15; 248/156, 350; D99/5

[56] References Cited

U.S. PATENT DOCUMENTS

| | | | |
|---|---|---|---|
| 1,448,808 | 3/1923 | McGowan | 47/41.14 |
| 2,062,684 | 12/1936 | Thomas | 27/1 |
| 2,610,443 | 9/1952 | Carlson | 47/41.14 |
| 2,789,397 | 4/1957 | Tritsch et al. | 47/41.14 |
| 3,001,326 | 9/1961 | O'Brien et al. | 47/41.14 |
| 4,927,118 | 5/1990 | Pierorazio | 248/156 X |
| 4,977,652 | 12/1990 | Graham | 27/1 |

*Primary Examiner*—Kien T. Nguyen
*Attorney, Agent, or Firm*—Roth & Goldman

[57] ABSTRACT

A receptacle adapted to contain ashes, such as human or animal ashes, and intended to be at least partially embedded in earth. The receptacle has a compartment for enclosing ashes, the compartment having an aperture for receiving the ashes. The receptacle also has a closure means for sealing the aperture and support means capable of supporting the receptacle in a vertical position in the earth. The receptacle is relocatable.

24 Claims, 4 Drawing Sheets

RECEPTACLE FOR ASHES OF DECEASED

This is a continuation of application Ser. No. 08/211,155 filed as PCT/AU92/00494 Sep. 18, 1992, now abandoned, from which priority is claimed under 35 USC 120.

TECHNICAL FIELD

This invention lies in the broad field of burial practices. More particularly, the invention relates to a receptacle for containing ashes at crematoria and the like.

Although the present invention will be described herein in connection with burial practices, it will be appreciated that the invention may find many different applications.

BACKGROUND ART

At present, ashes of deceased persons may be stored in wall compartments at crematoria. This is a commonly accepted but relatively expensive practice. An alternative offered is to place ashes in a garden at crematoria, with a plaque displaying the name and other details of the deceased person. However, this practice does not allow ashes to be contained in any type of a receptacle. Ashes are placed in a direct manner into the soil of the garden. In many cases, relatives and friends of the deceased person recoil at the idea that ashes will not be contained within the garden in such a way as to preserve the integrity of ashes.

In addition, the plaques themselves are usually mounted on a concrete base. These tend to sustain damage during gardening operations needed to maintain an attractive appearance of the garden. Periodically, the plaques must be moved in order to facilitate gardening operations. The concrete bases often fracture causing the plaques to appear dilapidated. The fractures may also result in difficulties in maintaining the bases in an upright position.

There is also a need for a receptacle to contain ashes of pets or other animals whose remains are desired to be preserved for sentimental reasons. At present, no eminently suitable receptacle exists.

The present invention seeks to overcome or at least substantially alleviate some or all of the problems referred to above and to provide a receptacle, for containing ashes at crematoria and the like, which is inexpensive and, which at the same time, is capable of preserving the integrity of ashes when placed in garden soil.

DISCLOSURE OF THE INVENTION

Accordingly, this invention provides a receptacle adapted to contain ashes or the like and intended to be at least partially embedded in earth, the receptacle consisting essentially of:

a compartment having an aperture, the aperture adapted to receive ashes or the like therethrough, closure means for sealing the aperture, and support means capable of supporting the receptacle in a vertical position in the earth, characterized in that the receptacle is relocatable.

It should be noted that the term "earth" is used herein to describe generally that part of the ground into which the receptacle may be fully or partially embedded.

Preferably, the receptacle is manufactured from a material such as stainless steel or the like. Stainless steel is readily available end relatively inexpensive to produce. However, any other material, capable of resisting corrosion for an appreciable period of time under the conditions of use as well as maintaining its structural integrity, may also be suitable.

In one form, the compartment is provided in the form of a cylinder, with the aperture at one end and a plug at the other end or base. The plug may be integral with the cylinder or rigidly attached to the cylinder by any suitable means. The plug can facilitate attachment of the support means, as described in more detail, below.

In one preferred embodiment of the present invention, the closure means consists of a plaque which can be firmly attached to the compartment at the aperture end so as to seal off the aperture by such suitable means as welding or the use of lugs, for example. The aperture end of the compartment preferably inclines so as to allow easy reading of the words on the plaque, when attached thereto.

In another preferred embodiment of the present invention, the closure means comprises an intermediate member adapted to seal off the aperture. The intermediate member is located between the aperture and the plaque and may be integral with or rigidly attached to the plaque by any suitable means.

It is especially preferred that locking means are provided to prevent removal of the closure means from the aperture once sealed. The locking means can consist of, for example, pop rivets or locking screws. The purpose of the locking means is to prevent tampering with the contents of the receptacle.

The support means may be integral with the compartment and may simply consist of an elongation thereof. However, it is especially preferred that the support means is a pointed stake, rigidly attached to or through the base end of the cylinder, via the plug, by any suitable means such as welding, for example. This form of the receptacle is relatively inexpensive to manufacture and, in addition, the moving of the receptacle during gardening is easier if the compartment is mounted on a pointed stake.

The support means may also take other forms, such as that descried later herein.

If desired, the receptacle of the present invention may include a vase, for example in the form of an elongated tube closed at one end and adapted to receive fresh flowers and water. Most conveniently, the vase is mounted on a bracket which can be attached to the support means, especially when the support means takes the form of a pointed stake.

It should be appreciated that the receptacle of the present invention may be of any appropriate size, so as to accommodate ashes of humans or animals, for example.

As indicated above, in one preferred embodiment, the compartment takes the form of a cylinder, with a capacity similar to that of a wall compartment in a crematorium. However, traditionally these wall compartments can accommodate only about 30% of the ashes of an average human. If it is desired to accommodate 100% of the ashes, there are two possibilities. The first is to manufacture the cylinder in a larger size, preferably elongated, so that 100% of the ashes can be contained within the cylinder. The second is to provide a subsidiary compartment which can accommodate the remaining 70% of the ashes. The subsidiary compartment may be cylinder shaped also and may attach to the first compartment by any suitable means, for example by welding or by screwing to the plug at the base of the first cylinder. In either case, the resulting elongated cylinder may have sufficient elongation to obviate the need for separate support means.

However, if separate support means are required, they may be provided as before, by attachment to the lowermost portion of the cylinder in its vertical position.

In the case where the receptacle of the invention is intended to contain the ashes of an animal or other pet, rather than a human, it may be desirable (and tasteful) to form the compartment in a shape other than that of a shape used for humans. For example, if receptacles for human ashes include a cylinder-shaped compartment, receptacles for animal ashes may have a compartment of non-cylindrical shape, such as a square pyramid, with the closure means comprising the square base of the pyramid. This face may also comprise the plaque, if one is required.

The receptacle of the present invention is suitable for use, inter alia, in a cemetery, memorial garden or house garden. However, in some situations there may be problems with unauthorised interference with, or even theft of, the receptacle.

To meet these circumstances, there may be provided a retaining bar for attachment to the receptacle of the invention, so that in use the retaining bar is buried in the earth, below the receptacle and is adapted to provide resistance to removal of the receptacle from the earth.

The retaining bar may be shared by two or more receptacles; this is particularly efficient when using the receptacles in cemeteries or memorial gardens.

Each receptacle may be attached to the retaining bar by any suitable means, of which examples are set out below.

BRIEF DESCRIPTION OF THE DRAWINGS

By way of example only, preferred embodiments of the present invention will now be described with reference to the accompanying drawings, in which.

DETAILED DESCRIPTION OF THE DRAWINGS

Figure 1:
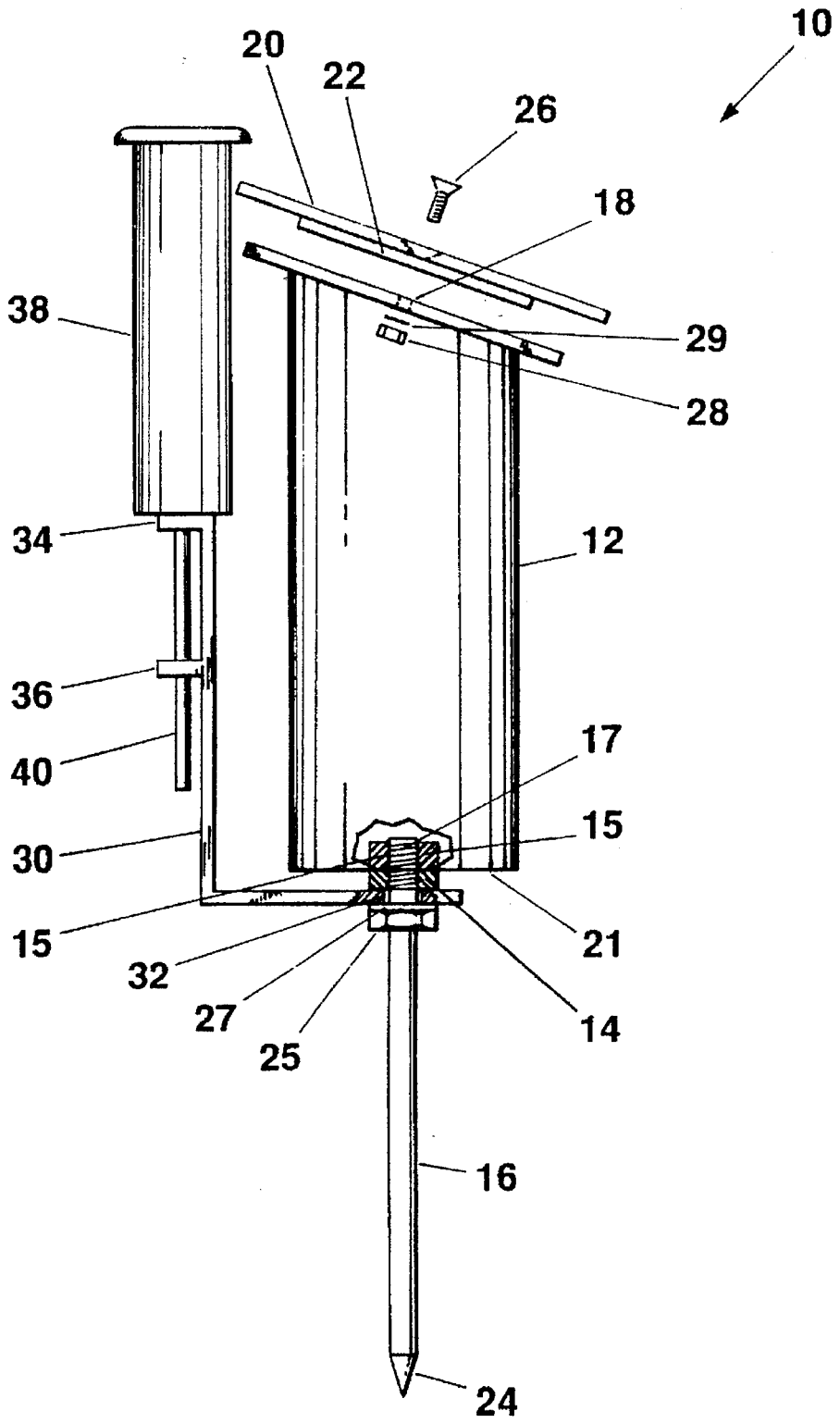
FIG. 1 is a side elevation of one embodiment of the receptacle in accordance with the present invention.

In FIG. 1, these is depicted receptacle 10 having compartment 12, plug 14 end stake 16.

Compartment 12 is cylindrical and has aperture 18 at the top end 19 thereof. Top end 19 is inclined, so as to allow easy reading of the words on plaque 20 (refer FIG. 2). Plaque 20 is attached to intermediate member 22 which serves to seal off aperture 18. Intermediate member 22 acts as a lid integral with plaque 20.

Plug 14 is welded to the base end 21 of compartment 12 and contains internal screw thread 15. Stake 16 is attached to compartment 12 by mating screw thread 17 with thread 15 of plug 14. Stake 15 includes point 24 to assist relocation of receptacle 10 in earth. Nut 25 and spring washer 27 help to stabilise stake 16.

After ashes of a decreased person or animal are deposited in compartment 12 through aperture 18, aperture 18 is sealed off by intermediate member 22 and plaque 20, secured thereto by a pair of locking screws 26 each co-operating with screwed nut 28 and spring washer 29. Stake 16 allows receptacle 10 to be embedded into the ground and to be supported in a vertical position.

Vase bracket 30 includes an aperture 32 through which stake 16 passes and includes rings 34 and 36. Vase 38 has a support stake 40 so that vase 38 can be removably supported by rings 34 and 36 of vase bracket 30. Vase 38 can contain water and fresh flowers as shown in FIG. 2.

Figure 2:
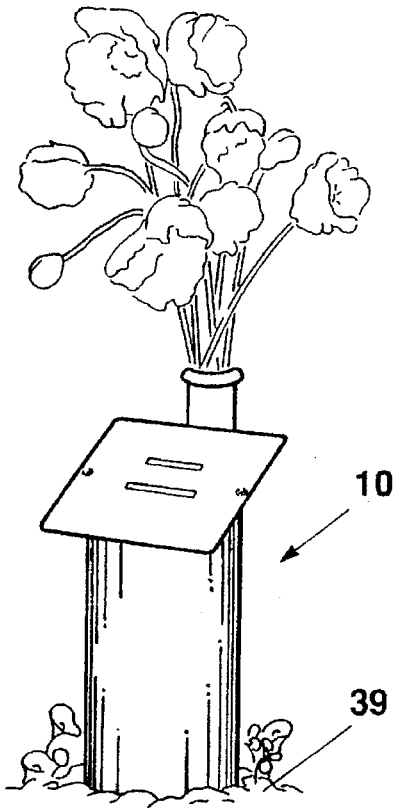
FIG. 2 is a front perspective view of the receptacle of FIG. 1, showing the receptacle partially embedded in the earth.

FIG. 2 shows receptacle 10 installed in a memorial garden, embedded in earth 39.

Figure 3:
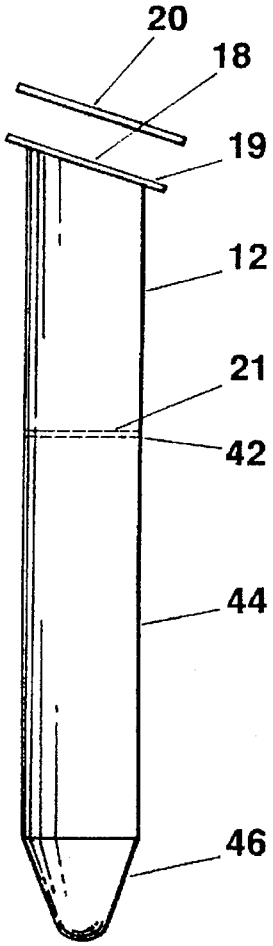
FIG. 3 is a side elevation of a second embodiment of the receptacle.

Turning now to FIG. 3, receptacle 10 has compartment 12 which once again is cylindrical in shape. Top end 19 has aperture 18 which can be sealed off by plaque 20. There is no intermediate member as in the embodiment of FIG. 1. Base end 21 of compartment 12 is welded at weld 42 to subsidiary compartment 44, which is cylindrical except for sealed base 46 which is frusto-conical. Approximately 30% of the ashes will be contained in compartment 12, with the remaining 70% in subsidiary compartment 44, with the latter acting as the support means. The shape of base 46 assists relocation of receptacle 10, if that is desired.

Of course, receptacle 10 may also consist of a single elongated cylinder extending from the top end 19 to base 46. However, from a marketing viewpoint it is more cost efficient to provide a standard sized compartment 12, to which a subsidiary compartment 44 may be attached, to cater for those cases where it is desired to contain 100% of the ashes.

Figure 4A:
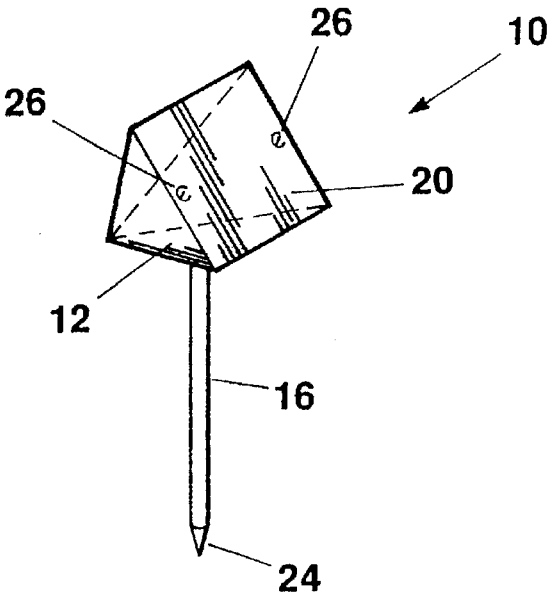
FIG. 4A is a perspective view of a third embodiment of the receptacle.
Figure 4B:
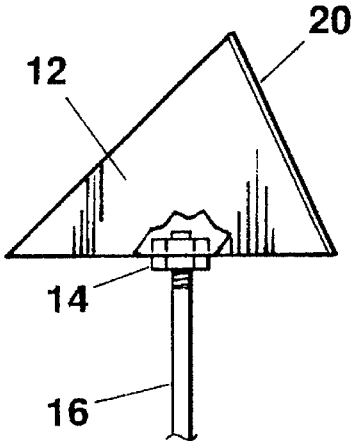
FIG. 4B is a side elevation of the receptacle in FIG. 4A.

FIGS. 4A and 4B illustrate a non-cylindrical compartment. In thin embodiment, receptacle 10 has compartment 12 in the shape of a square pyramid secured by plug 14 to stake 16 having point 24. Plaque 20 seals aperture 18 (not shown) via screws 26. If receptacles having cylindrical compartments are marketed for human remains, receptacles having pyramidal compartments as in FIGS. 4A and 4B can be marketed for animal remains, to clearly delineate the markets.

Figure 5:
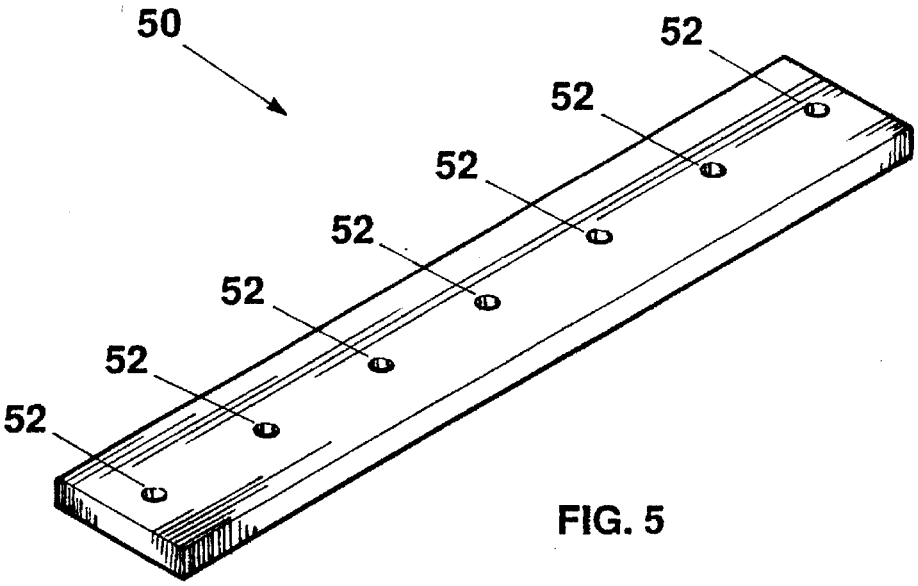
FIG. 5 is a perspective view of an embodiment of the retaining bar.

In FIG. 5, retaining bar 50 consists of a stainless steel bar approximately 350 mm long, 50 mm wide and 5 mm thick. Cavities 52 are drilled at 50 mm centres along the length bar 50.

Figure 6:
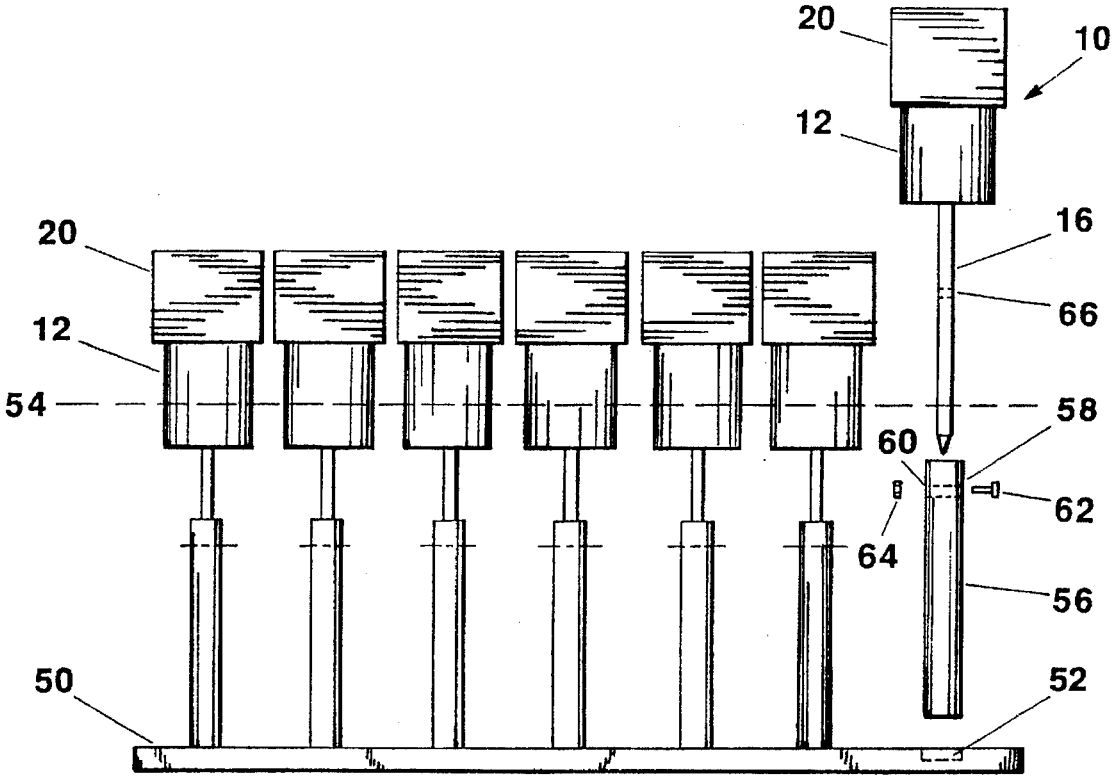
FIG. 6 shows a number of receptacles of FIG. 1 attached to the retaining bar of FIG. 5 by one attachment means.

FIG. 6 shows bar 50 in place in a cemetery. The level of the soil is indicated by dashed line 54. Pipes 56 are welded into cavities 52 and include a pair of small holes 58 end 60 adapted to receive a threaded bolt 62 which can be retained by nut 64.

Stake 16 of receptacle 10 includes a drilled passage 66. When stake 16 is inserted in pipe 56, passage 66 can be aligned with holes 58 and 60. Bolt 62 can pass through hole 58, passage 66 and hole 60, to be secured by nut 64. In this way, receptacle 10 my be locked to retaining bar 50, so that it is extremely difficult for vandals and the like to dislodge receptacles 10 from their site.

Figure 7:
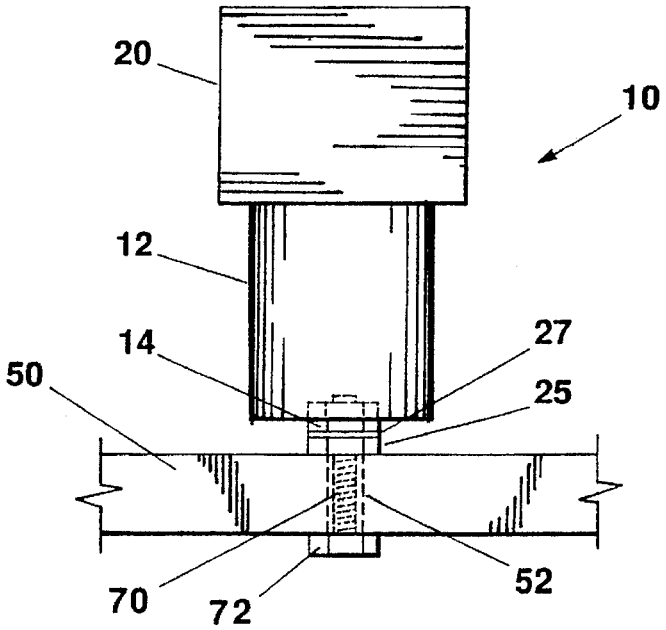
FIG. 7 shows a number of receptacles of FIG. 1, in a slightly modified form, attached to the retaining bar of FIG. 5 by a second attachment means.

FIG. 7 shows another use of bar 50, preferred when it is desired to use less depth of earth than in the case of the embodiment in FIG. 6. In this embodiment, cavities 52 are drilled all the way through bar 50. Receptacle 10 is secured to bar 50 by threaded bolt 70, having head 72. Bolt 70 in co-operation with bar 50 comprises the supporting means in this embodiment. Bolt 70 is screwed to plug 14 as in the embodiment of FIG. 1 with nut 25 and spring washer 27 locking bolt 70 to plug 14. Bolt 70 can then be rotated within bar 50 but cannot easily be removed therefrom. Thus receptacle 10 is retained in position. If desired, bar 50 can be linked to one or more further bars 50, to form, for example, a grid of bars supporting receptacle 10.

INDUSTRIAL APPLICABILITY

It will be appreciated that the receptacle of the present invention is a simple but effective advance over the prior art.

It will be also appreciated that the preferred embodiment of the present invention disclosed herein is given by way of example only and is not intended to be limiting on the scope of the present invention.

It will be further appreciated that changes obvious to those skilled in the art are not considered to be beyond of the scope of the present invention.

I claim:

1. A deceased's ash and cremated remains receptacle adapted to contain ashes and cremated remains and intended to be at least partially embedded in earth, the receptacle comprising:

a watertight cremated remains compartment configured for enclosing ashes and cremated remains, the compartment having a sealable aperture adapted to receive ashes and cremated remains therethrough;

tamper resistant closure means for permanently sealing the aperture so as to be watertight;

means for identification of the ashes and cremated remains of the deceased placed within said cremated remains compartment, said means for identification being adapted for displaying symbols identifying the ashes and cremated remains of the deceased placed within said cremated remains compartment, said means for identification being incorporated in said closure means; and support means capable of supporting the receptacle in a vertical position in the earth, whereby the receptacle is adapted to contain ashes and cremated remains of a deceased and to function as a memorial.

2. A receptacle as claimed in claim 1, wherein the cremated remains compartment is cylindrical.

3. A receptacle as claimed in claim 1, wherein the compartment is pyramidal.

4. A receptacle as claimed in claim 1, wherein the cremated remains compartment, the closure means and the support means each comprise components manufactured of stainless steel.

5. A receptacle as claimed in claim 1, wherein the closure means comprises a plaque.

6. A receptacle as claimed in claim 1, wherein the closure means comprises an intermediate member attached to a plaque.

7. A receptacle as claimed in claim 1, wherein locking means are provided to prevent removal of the closure means from the aperture once sealed.

8. A receptacle as claimed in claim 1, wherein the support means are integral with the compartment.

9. A receptacle as claimed in claim 1, wherein the support means consist of a pointed stake rigidly attached to or through the cremated remains compartment.

10. A receptacle as claimed in claim 1, wherein the support means consists of a second, elongated compartment attached to the watertight compartment.

11. A receptacle as claimed in claim 1, wherein a retaining bar is provided and adapted to attachment to the receptacle to resist removal of the receptacle from the earth.

12. A receptacle as claimed in claim 11, wherein the support means consists of a fastener retained in the retaining bar.

13. A receptacle as claimed in claim 1, wherein a vase is mounted on a bracket attached to the support means.

14. The receptacle of claim 1, wherein the closure means includes a permanent connection of a type chosen from a group of connection types consisting of a welded connection, a connection effected by use of lugs, and a connection effected by use of separate fasteners.

15. The receptacle of claim 14, wherein the fasteners are of a type chosen from a group of fastener types consisting of pop rivets and locking screws.

16. A receptacle adapted to contain ashes and cremated remains and intended to be at least partially embedded in earth, the receptacle comprising:

a watertight cylindrical cremated remains compartment for enclosing ashes and cremated remains having first and second ends, the compartment having at the first end of the cylinder a sealable aperture adapted to receive ashes and cremated remains therethrough;

closure means comprising a plaque adapted to identify the received ashes and cremated remains for permanently sealing the aperture so as to be watertight, said closure means further comprising a fastening means for fastening said plaque and said cylinder together and closing said aperture in a tamper resistant manner; and elongated support means comprising a pointed stake screwed to an end of the cylinder opposite the first end and capable of supporting the receptacle in a vertical position in the earth.

17. The receptacle of claim 16, wherein the fastening means includes a permanent connection of a type chosen from a group of connection types consisting of a welded connection and a connection effected by use of lugs.

18. The receptacle of claim 16, wherein the fastening means further comprises separate fasteners.

19. The receptacle of claim 18, wherein the fasteners are of a type chosen from a group of fastener types consisting of pop rivets and locking screws.

20. A deceased's ash and cremated remains receptacle adapted to contain ashes and cremated remains and intended to be at least partially embedded in earth, the receptacle comprising:

a watertight cremated remains compartment configured for enclosing ashes and cremated remains, the compartment having a sealable aperture adapted to receive ashes and cremated remains therethrough;

tamper resistant closure means for permanently sealing the aperture so as to be watertight, said closure means further comprising fastening means for permanently fastening elements of the receptacle together in effecting a sealed closure of the aperture;

a plaque adapted to display an identification of the ashes and cremated remains of the deceased placed within said cremated remains compartment; and support means capable of supporting the receptacle in a vertical position in the earth.

21. The receptacle of claim 20, wherein the cremated remains compartment is cylindrical.

22. The receptacle of claim 20, wherein the closure means includes a permanent connection of a type chosen from a group of connection types consisting of a welded connection, a connection effected by use of lugs, and a connection effected by use of separate fasteners.

23. The receptacle of claim 22, wherein the fasteners are of a type chosen from a group of fastener types consisting of pop rivets and locking screws.

24. The receptacle of claim 20, whereto the plaque is disposed in relation to the receptacle so as to be at an oblique angle with respect to a horizontal surface of the earth when the receptacle is supported in a vertical position in the earth by the support means.

* * * * *